US006482029B2

(12) United States Patent
Nishimura

(10) Patent No.: US 6,482,029 B2
(45) Date of Patent: Nov. 19, 2002

(54) CARD CONNECTOR

(75) Inventor: Takeshi Nishimura, Santa Clara, CA (US)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 09/842,083

(22) Filed: Apr. 26, 2001

(65) Prior Publication Data

US 2001/0039129 A1 Nov. 8, 2001

(30) Foreign Application Priority Data

Apr. 27, 2000 (JP) ..... 2000-128488

(51) Int. Cl.[7] ..... H01R 13/60

(52) U.S. Cl. ..... 439/541.5; 439/637; 439/188; 439/329; 439/489; 200/51.09

(58) Field of Search ..... 439/188, 541.5, 439/64, 79, 489, 631, 326–329, 637; 200/51.09

(56) References Cited

U.S. PATENT DOCUMENTS

| | | | | |
|---|---|---|---|---|
| 3,283,107 A | | 11/1966 | Anson | 200/574 |
| 3,631,381 A | | 12/1971 | Pittman | 439/637 |
| 3,932,016 A | | 1/1976 | Ammenheuser | 235/492 |
| 4,392,705 A | | 7/1983 | Andrews, Jr. et al. | 439/660 |
| 4,507,697 A | * | 3/1985 | Ozil et al. | 200/51.09 |
| 4,864,116 A | | 9/1989 | Banjo et al. | 439/159 |
| 5,033,972 A | | 7/1991 | Komatsu et al. | 439/153 |
| 5,145,389 A | | 9/1992 | Okubo | 439/159 |
| 5,197,894 A | | 3/1993 | Koike | 439/159 |
| 5,207,598 A | | 5/1993 | Yamada et al. | 439/157 |
| 5,286,207 A | | 2/1994 | McHugh | 439/159 |
| 5,320,552 A | | 6/1994 | Reichardt et al. | 439/331 |
| 5,374,198 A | | 12/1994 | Nagata | 439/157 |
| 5,492,480 A | | 2/1996 | Fusselman et al. | 439/157 |
| 5,492,481 A | | 2/1996 | Lewis | 439/159 |

(List continued on next page.)

FOREIGN PATENT DOCUMENTS

| | | |
|---|---|---|
| EP | 0 284 431 | 9/1988 |
| JP | 1168978 | 7/1989 |
| JP | 7 153524 | 6/1995 |
| JP | 8 166906 | 6/1996 |
| JP | 9 7694 | 1/1997 |
| JP | 10 91729 | 4/1998 |
| JP | 10187896 | 7/1998 |
| JP | 10 240871 | 9/1998 |
| JP | 10255012 | 9/1998 |
| JP | 10255910 | 9/1998 |
| JP | 2000-251024 | 9/2000 |
| JP | 2000-277207 | 10/2000 |

OTHER PUBLICATIONS

U.S. patent application Ser. No. 09/703,682, Ito et al., filed Nov. 02, 2000.

(List continued on next page.)

*Primary Examiner*—P. Austin Bradley
*Assistant Examiner*—Briggitte R. Hammond
(74) *Attorney, Agent, or Firm*—Finnegan, Henderson, Farabow, Garrett & Dunner LLP

(57) ABSTRACT

A first slot for containing a first card and a second slot for containing the second card are disposed in upper and lower sides, the first contact terminals are disposed so that respective soldered portions 40*a* of a plurality of first contact terminals for the first card are positioned at one side of front surface and rear surface sides of a connector housing, and said second contact terminals are disposed in opposition to the first contact terminals so that respective soldered portions 50*a* of a plurality of second contact terminals for the second card are positioned at the other side of the front surface and rear surface sides of the connector housing.

10 Claims, 14 Drawing Sheets

U.S. PATENT DOCUMENTS

| | | | | | |
|---|---|---|---|---|---|
| 5,511,986 | A | | 4/1996 | Casey | 439/157 |
| 5,533,906 | A | | 7/1996 | Abe | 439/159 |
| 5,581,127 | A | | 12/1996 | Shinohara | 257/679 |
| 5,648,651 | A | | 7/1997 | Inoue | 439/159 |
| 5,655,918 | A | | 8/1997 | Soh | 439/157 |
| 5,668,365 | A | | 9/1997 | Ito et al. | 235/486 |
| 5,695,351 | A | | 12/1997 | Kimura et al. | 439/159 |
| 5,716,221 | A | | 2/1998 | Kantner | 439/64 |
| 5,718,609 | A | | 2/1998 | Braun et al. | 439/630 |
| 5,725,385 | A | * | 3/1998 | Takano et al. | 439/541.5 |
| 5,890,920 | A | | 4/1999 | David et al. | 439/159 |
| 5,899,763 | A | | 5/1999 | Kajiura | 439/159 |
| 5,904,597 | A | | 5/1999 | Doi et al. | 439/660 |
| 5,911,587 | A | | 6/1999 | Vermeersch | 439/188 |
| 5,923,541 | A | | 7/1999 | Yasumi | 439/159 |
| 5,933,328 | A | | 8/1999 | Wallace et al. | 439/326 |
| 5,967,810 | A | | 10/1999 | Spickler et al. | 439/159 |
| 5,993,261 | A | | 11/1999 | Klatt et al. | 439/630 |
| 6,004,155 | A | * | 12/1999 | Wu | 439/489 |
| 6,015,311 | A | | 1/2000 | Benjamin et al. | 439/267 |
| 6,036,548 | A | * | 3/2000 | Braithwaite | 439/637 |
| 6,039,599 | A | | 3/2000 | Benjamin et al. | 439/660 |
| 6,059,592 | A | | 5/2000 | Inadama | 439/188 |
| 6,065,984 | A | | 5/2000 | Tung | 439/159 |
| 6,068,500 | A | | 5/2000 | Kantner | 439/541.5 |
| 6,073,853 | A | | 6/2000 | Odic | 439/159 |
| 6,083,018 | A | | 7/2000 | Hara et al. | 439/159 |
| 6,089,919 | A | | 7/2000 | Nishioka | 439/630 |
| 6,095,834 | A | | 8/2000 | Lai et al. | 439/159 |
| 6,099,335 | A | * | 8/2000 | Chang | 439/188 |
| 6,102,715 | A | | 8/2000 | Centofante | 439/630 |
| 6,106,313 | A | | 8/2000 | Chen | 439/159 |
| 6,120,309 | A | | 9/2000 | Hara | 439/159 |
| 6,126,486 | A | | 10/2000 | Chang | 439/630 |
| 6,129,571 | A | | 10/2000 | Ikemoto | 439/260 |
| 6,139,340 | A | | 10/2000 | Niitsu | 439/159 |
| 6,152,748 | A | | 11/2000 | Sato et al. | 439/159 |
| 6,159,027 | A | | 12/2000 | Kuo | 439/159 |
| 6,162,075 | A | | 12/2000 | Hara et al. | 439/159 |
| 6,162,089 | A | | 12/2000 | Costello et al. | 439/541.5 |
| 6,174,197 | B1 | | 1/2001 | Hirata et al. | 439/541.5 |
| 6,174,198 | B1 | | 1/2001 | Wu et al. | 439/159 |
| 6,176,737 | B1 | | 1/2001 | Choy | 439/541.5 |
| 6,183,292 | B1 | | 2/2001 | Chen | 439/607 |
| 6,200,148 | B1 | | 3/2001 | Yu | 439/159 |
| 6,210,187 | B1 | | 4/2001 | Tung | 439/159 |
| 6,213,785 | B1 | | 4/2001 | Nishio et al. | 439/64 |
| 6,227,879 | B1 | | 5/2001 | Dong | 439/92 |
| 6,231,360 | B1 | | 5/2001 | Horie | 439/159 |
| 6,234,813 | B1 | | 5/2001 | Hanyu | 439/159 |
| 6,234,845 | B1 | | 5/2001 | Hakozaki | 439/633 |
| 6,250,965 | B1 | | 6/2001 | Neifer | 439/630 |
| 6,261,128 | B1 | | 7/2001 | Heim et al. | 439/630 |
| 6,270,365 | B1 | | 8/2001 | Nishioka | 439/159 |
| 6,273,737 | B1 | | 8/2001 | Furusho et al. | 439/159 |
| 6,290,136 | B1 | | 9/2001 | Koseki et al. | 439/159 |
| 6,302,715 | B1 | | 10/2001 | Sato et al. | 439/159 |
| 6,319,029 | B2 | | 11/2001 | Nishioka | 439/159 |
| 6,328,605 | B1 | | 12/2001 | Walker et al. | 439/631 |
| 6,390,836 | B1 | | 5/2002 | Motegi et al. | |

OTHER PUBLICATIONS

U.S. patent application Ser. No. 09/703,676, Sato et al., filed Nov. 02, 2000.

U.S. patent application Ser. No. 09/703,669, Ito et al., filed Nov. 02, 2000.

U.S. patent application Ser. No. 09/705,747, Ito et al., filed Nov. 07, 2000.

U.S. patent application Ser. No. 09/706,786, Ito et al., filed Nov. 07, 2000.

U.S. patent application Ser. No. 09/869,756, Takada et al., filed Jul. 05, 2001.

U.S. patent application Ser. No. 09/869,784, Ito et al., filed Jul. 05, 2001.

U.S. patent application Ser. No. 09/889,007, Abe et al., filed Jul. 06, 2001.

U.S. patent application Ser. No. 09/890,637, Abe et al., filed Aug. 03, 2001.

U.S. patent application Ser. No. 09/922,866, Ito et al., filed Aug. 07, 2001.

U.S. patent application Ser. No. 09/890,950, Shishikura et al., filed Aug. 08, 2001.

U.S. patent application Ser. No. 09/978,661, Sato, filed Oct. 18, 2001.

U.S. patent application Ser. No. 09/978,660, Sato, filed Oct. 18, 2001.

U.S. patent application Ser. No. 10/046,716, Ooya, filed Jan. 17, 2002.

* cited by examiner

CARD CONNECTOR

This application is based on Patent Application No. 2000-128488 filed Apr. 27, 2000 in Japan, the content of which is incorporated hereinto by reference.

BACKGROUND OF THE INVENTION

1. Field of the Invention

The present invention relates to a card connector mounted to electronic equipments such as cellular phones, telephones, PDA (personal digital assistance), portable audio, cameras and the like, more specifically to a card connector which can be loaded simultaneously with at least two cards of different types differing in outer shape, contact pad position or the like.

2. Description of Prior Art

In electronic machines such as cellular phones, telephones, PDA, cameras and the like, various functional expansions are achieved by mounting IC cards such as SIM (subscriber identify module) card, MMC (multimedia card; ™), SMART MEDIA™, SD (super density: secure digital) card, MEMORY STICK™ and the like, which ICs (integrated circuits) such as memories or the like are included. IC cards, a plurality of contact terminals connected with various signal processing circuits at the electronic machine side mounted with the connector and a power supply circuit are provided in a connector housing, and these plurality of contact terminals are contacted with a plurality of contact pads formed on the front or backside of the mounted IC card, so that the IC card is electrically connected through these contacts with the electronic machines mounting the connector.

As described above, IC cards of this kind include various cards differing in outer shape or contact pad position, however, recently, a card connector is in demand which can be loaded with cards of a plurality of different types simultaneously so that the electronic machines can be adaptable to cards of a plurality of types.

For example, when considering a card connector which is possible to be loaded with two types of card, as one construction thereof, a card slot is constructed so that two types of card arranged side by side to the right and left can be inserted.

However, when cards are arranged side by side to the right and left, connector area on the substrate is increased which is a disturbance in downsizing of the electronic machine. Further, in the card connector, to make respective cards operative normally, it is essential that a card recognition switch is provided for recognizing the inserted card, however, when the card slots are arranged side by side to the right and left as above, as card recognition switches, two contact strips are necessary for each card, leading to an increase in number of portions and in cost.

Furthermore, as another configuration of connector capable of loading with two types of card, a technique is considered in which the card slot is constructed so that cards can be inserted in a positional relation of upper and lower sides.

In this case, however, because, when respective contact terminals for two types of card are arranged so that the respective contact terminals are pressed in and fixed in a same direction (for example, contact terminals are pressed from a card rear surface wall side to a card ejection direction), soldered portions of respective contact terminals are concentrated to one of rear surface side and front surface side of the card housing, these soldered portions tend to be interfered with each other, and the layout thereof becomes very difficult.

That is, in this type of card connector, the plurality of contact terminals are required to be arranged so that soldered portions fixed to the printed circuit board are disposed in a single line with an appropriate pitch for subsequent repair (soldered portion is peeled off using an soldering iron (electric type)), image recognition when the board is mounted or for image inspection of the soldered portions. When the soldered portions are arranged in two rows, the outside soldered portions are accessed by the soldering iron, however, the inside soldered portions are not accessible by the soldering iron. To dispose soldered portions of a plurality of contact terminals in a line, it is necessary to arrange soldered portions of contact terminals for one card between pitches of soldered portions of the other card, when the pitch is small in width, the arrangement thereof becomes substantially impossible.

Furthermore, as described above, since, in each of this type of card, the pitch of a contact pad are naturally different from each other, in order to arrange in a line the respective soldered portions of respective cards of different-pitched contact pad, it is necessary to devise a complex shape of soldered portion of contact terminals, which poses a problem of difficulty in manufacture.

In the present invention which has been made in consideration of the above circumstances, an object thereof is to provide a card connector which is capable of containing two or more types of card differing in outer shape or contact pad position, in which required substrate area can be reduced, and layout work of contact terminals, soldering work and maintenance and servicing work and the like can easily be carried out.

SUMMARY OF THE INVENTION

With the aim of achieving the above object of the present invention, in one aspect of the present invention, there is provided a card connector which is capable of containing at least two types of first and second cards differing in outer shape and contact pad position, the card connector comprising, a connector housing configured so that a first slot containing the first card and a second slot containing the second card are disposed in upper and lower sides, wherein the first contact terminals are disposed so that respective soldered portions of a plurality of contact terminals for the first card are positioned at one side of front surface side and rear surface side of the connector housing, and the second contact terminals are disposed in the opposite direction to the first contact terminals so that a plurality of contact terminals for the second card are positioned at the other side of front surface and rear surface sides of the connector housing.

According to the present invention, respective slots for two types of card are disposed in upper and lower sides, first and second contact terminals for respective cards are disposed so that respective press-fit directions are opposite to each other.

Therefore, even if the respective slots for two types of card are disposed in upper and lower sides, respective soldered portions of the first and second contact terminals will not interfere with one another, and the respective soldered portions can easily be arranged each in a single line.

As a result, press-fit operation of respective contact terminals becomes easy, image recognition of soldered portions at the time of substrate mounting and image inspection of soldered portions are made easy, and repair work using an soldering iron (electric type) becomes easy.

The above and other objects, features and advantages of the present invention will become more apparent from the following description of embodiments thereof taken in conjunction with the accompanying drawings.

DESCRIPTION OF PREFERRED EMBODIMENTS

In the following, an embodiment of the present invention will be described in detail with reference to the drawings.

First, two types of card will be described which can be loaded on the card connector of the embodiment shown below.

Figure 1:
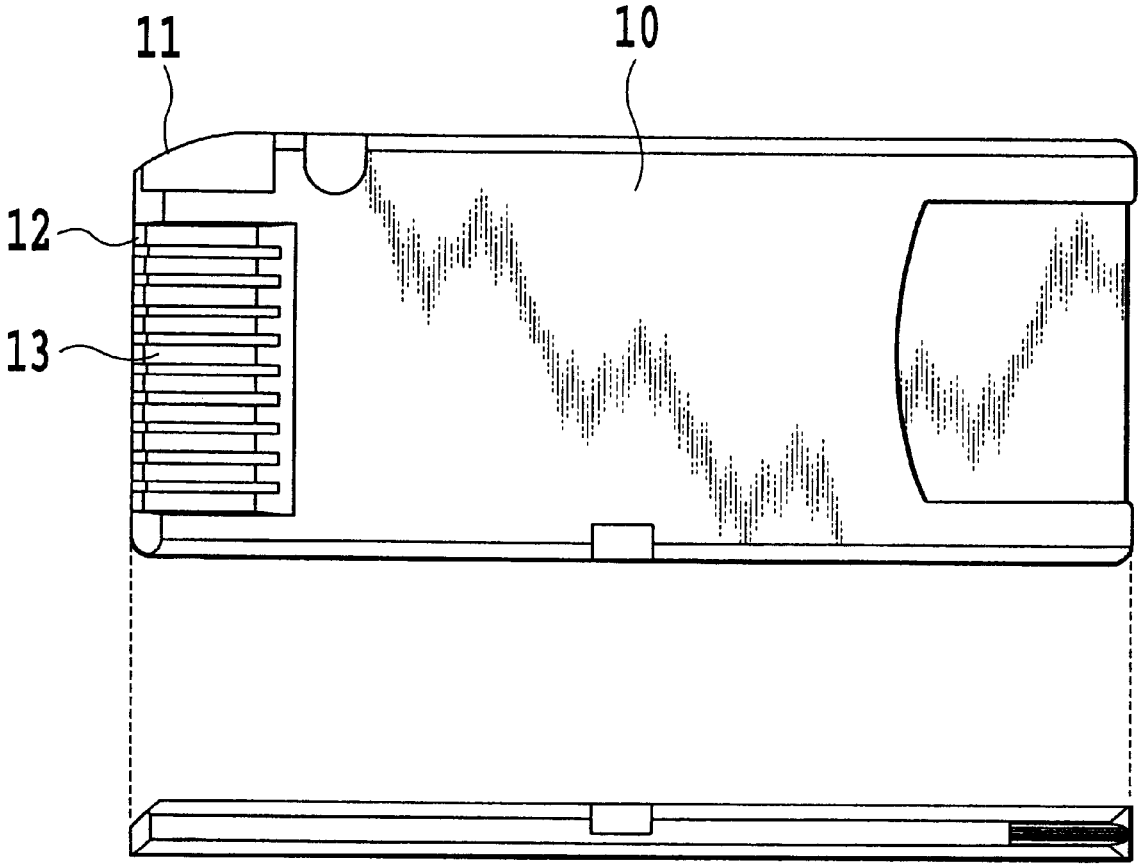
FIG. 1 is a perspective view exemplifying a narrow type card.

FIG. 1 shows the outer appearance of contact pad surface and side surface of a MEMORY STICK™ as an example of a narrow-type card 10.

The narrow-type card 10 has a chamfered portion 11 for improper insertion prevention at its tip edge portion. At the tip side of the card main body 10, a plurality of recesses 12 are formed, and respective contact pads 13 are disposed on the bottom surfaces of these recesses 12. The contact pads 13 employ a 10-pin type.

Figure 2:
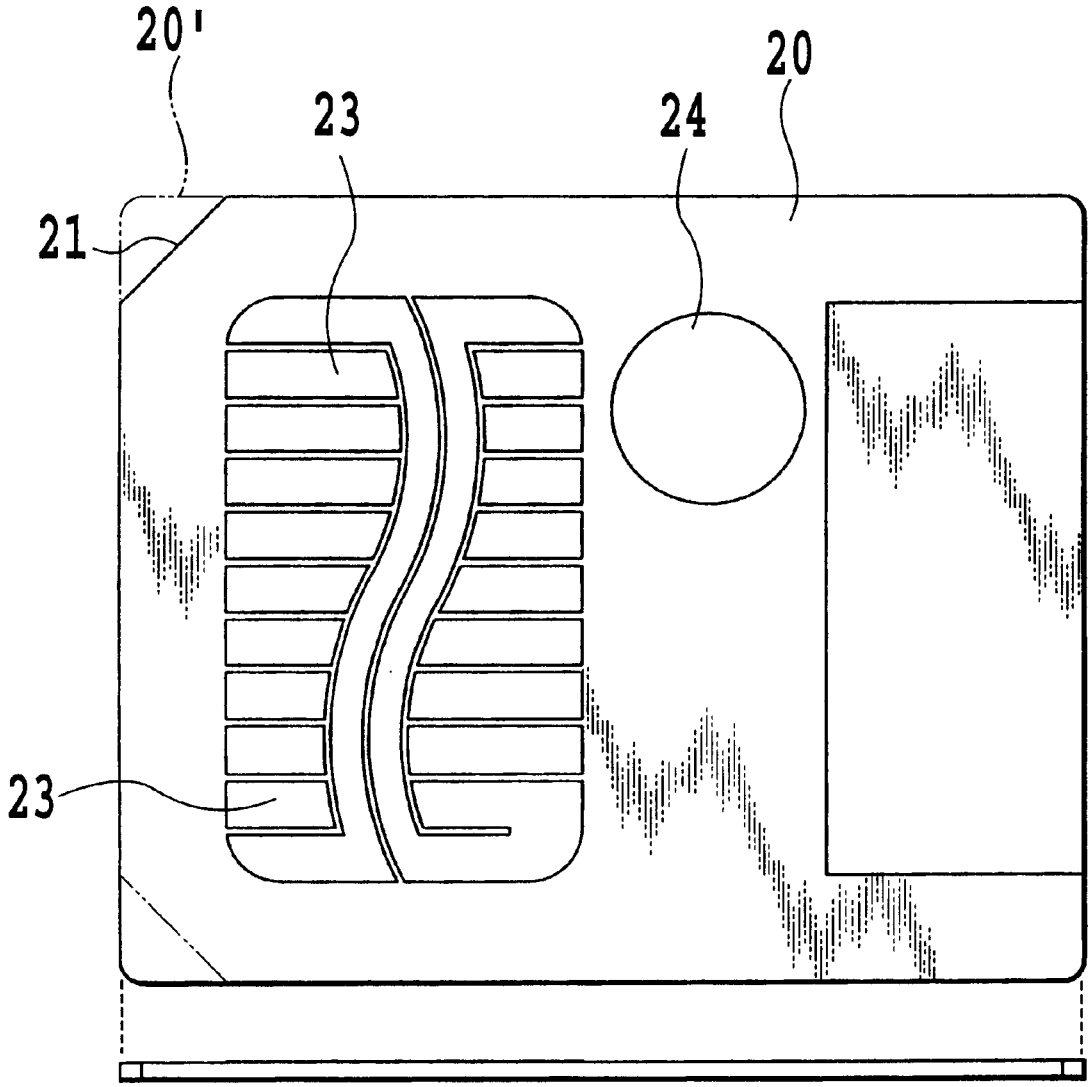
FIG. 2 is a perspective view exemplifying a thin type card.

FIG. 2 shows the outer appearance of contact pad surfaces and side surface of a SMART MEDIA™ as an example of a thin-type card 20.

The thin-type card 20 is larger in plane size but smaller in thickness compared to the narrow-type card 10. At one edge part of the tip of the card 20, a chamfered portion 21 for improper insertion prevention is formed. At the tip side of the card 20, a contact area provided with a plurality of contact pads 23 is disposed. Reference numeral 24 denotes a write protect pad for improper erase prevention. As described above, as compared with the narrow-type card 10, the thin-type card 20 is quite different in its outer shape, plane size, thickness, and contact pad position.

Next, an embodiment of the card connector according to the present invention will be described with reference to FIGS. 3 to 14.

Figure 3:
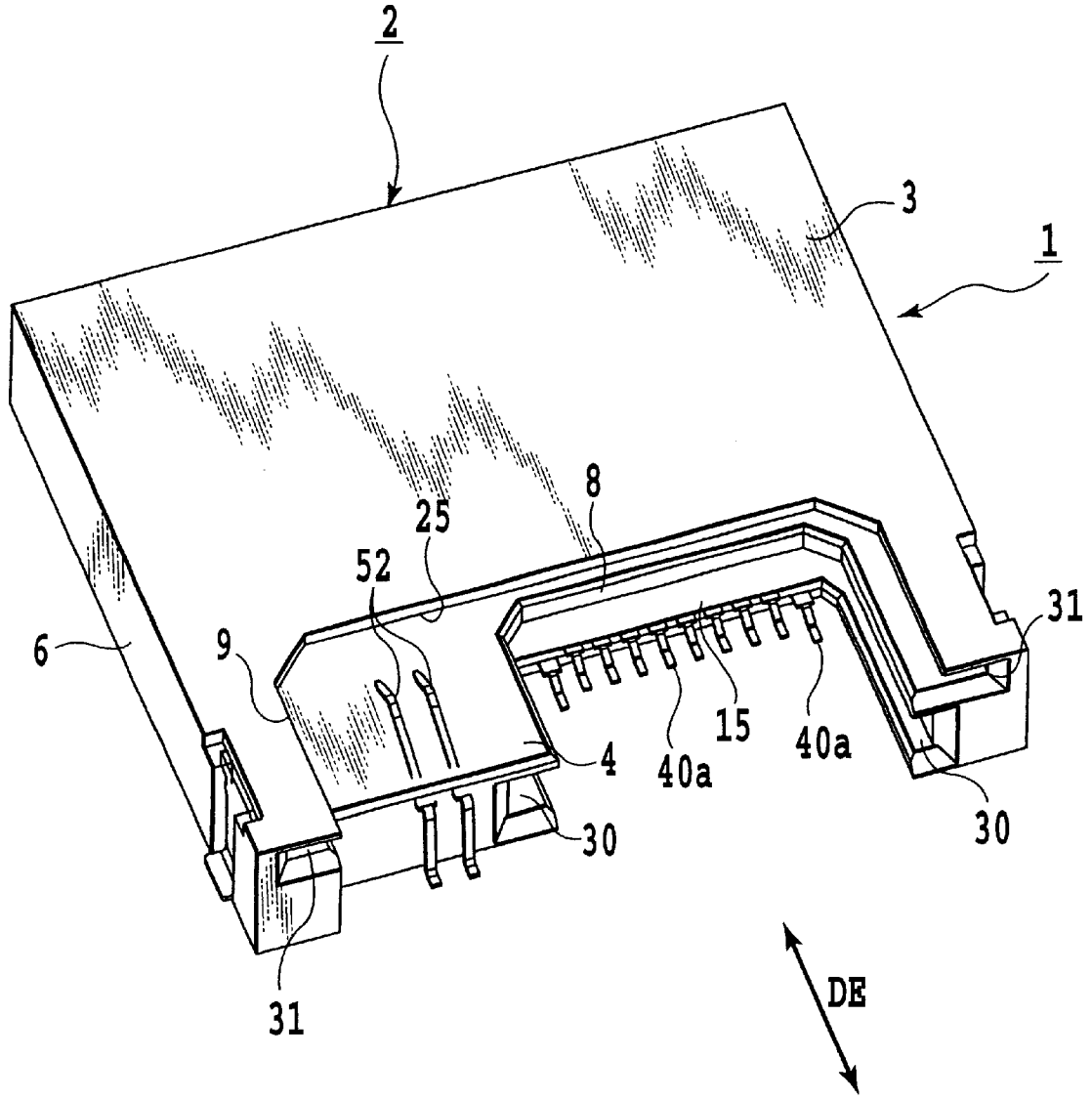
FIG. 3 is a perspective view showing the outer construction of an embodiment of the card connector according to the present invention.
Figure 4:
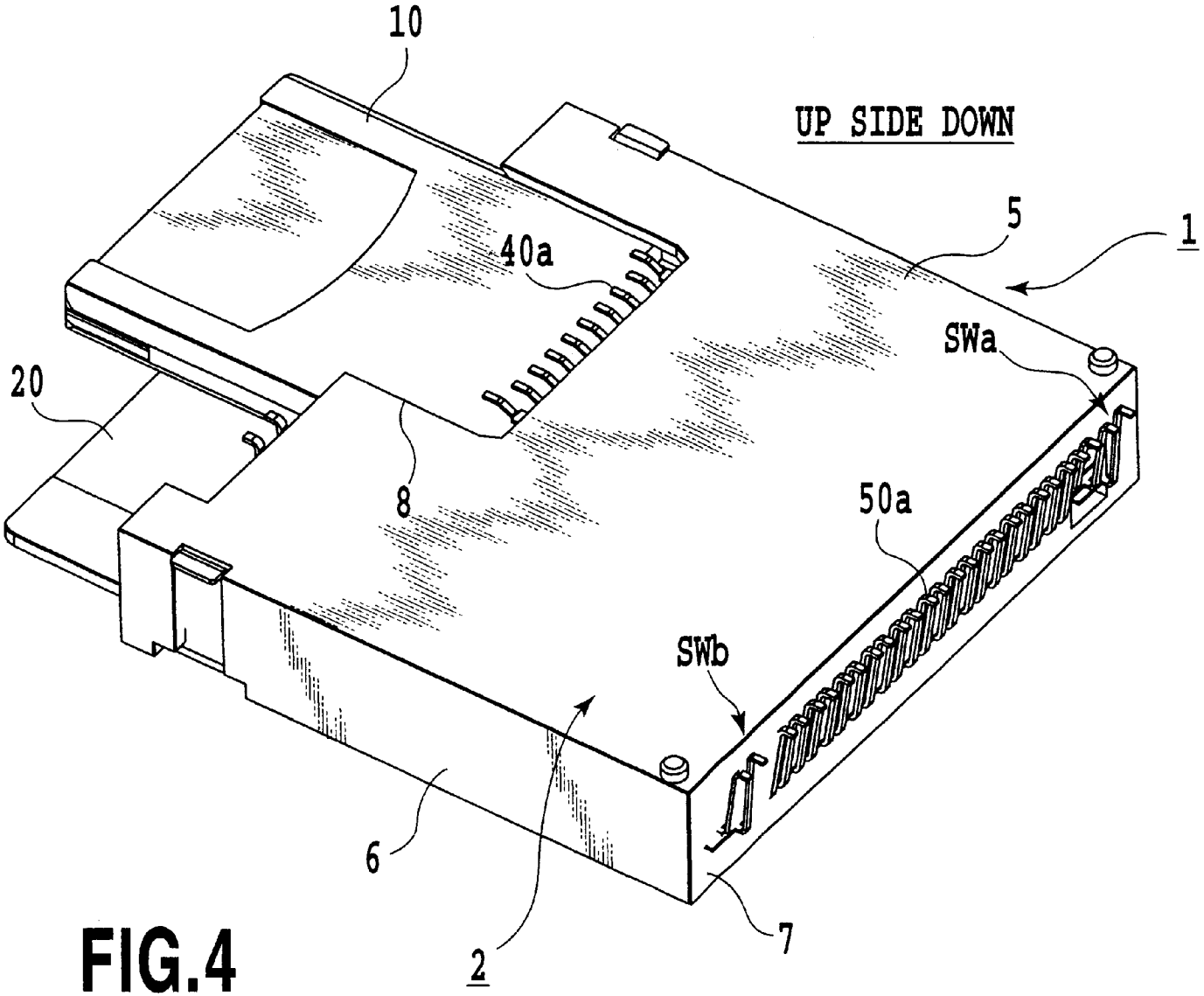
FIG. 4 is a perspective view showing the outer construction, shown upside down, of the embodiment of the card connector according to the present invention.
Figure 5:
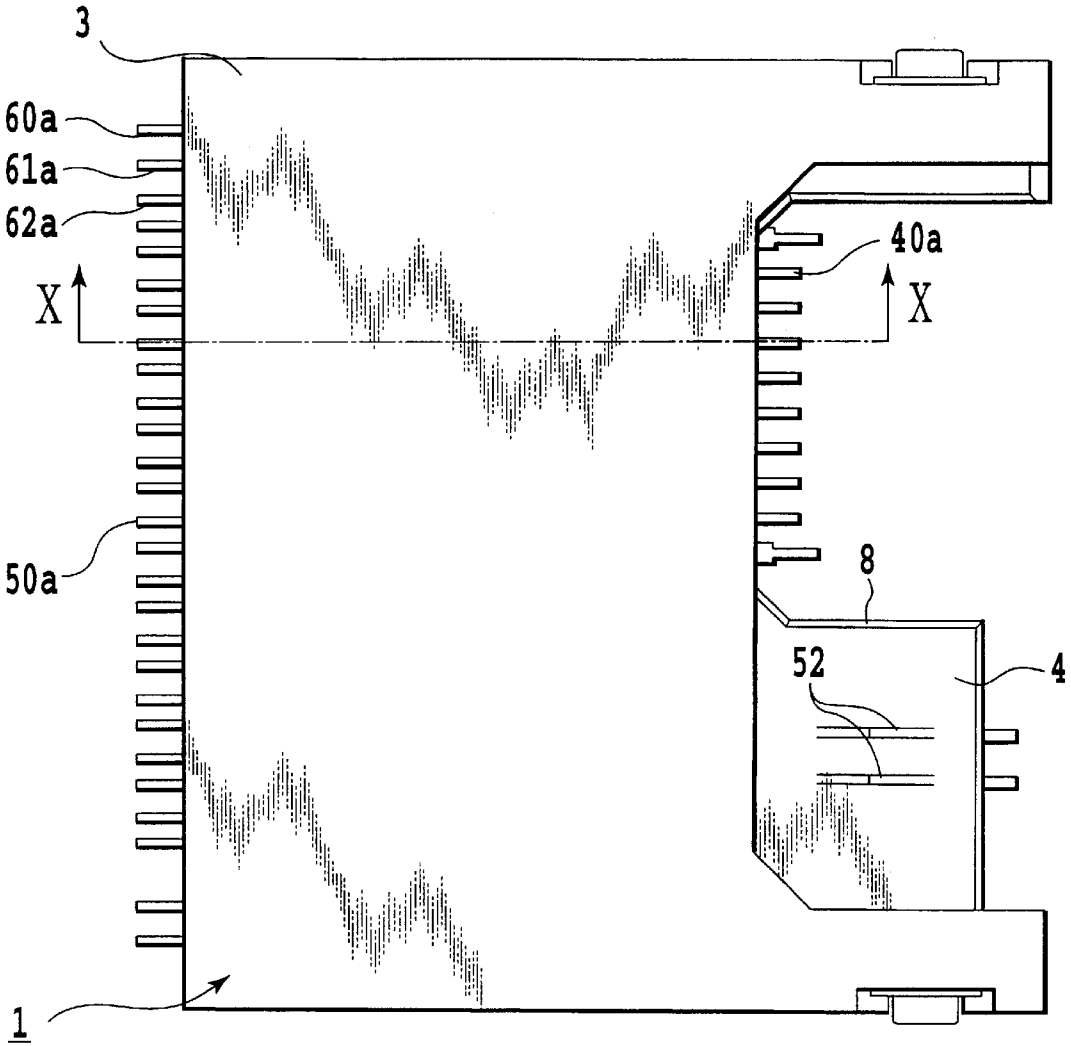
FIG. 5 is a plane view showing the embodiment of the card connector according to the present invention.
Figure 6:
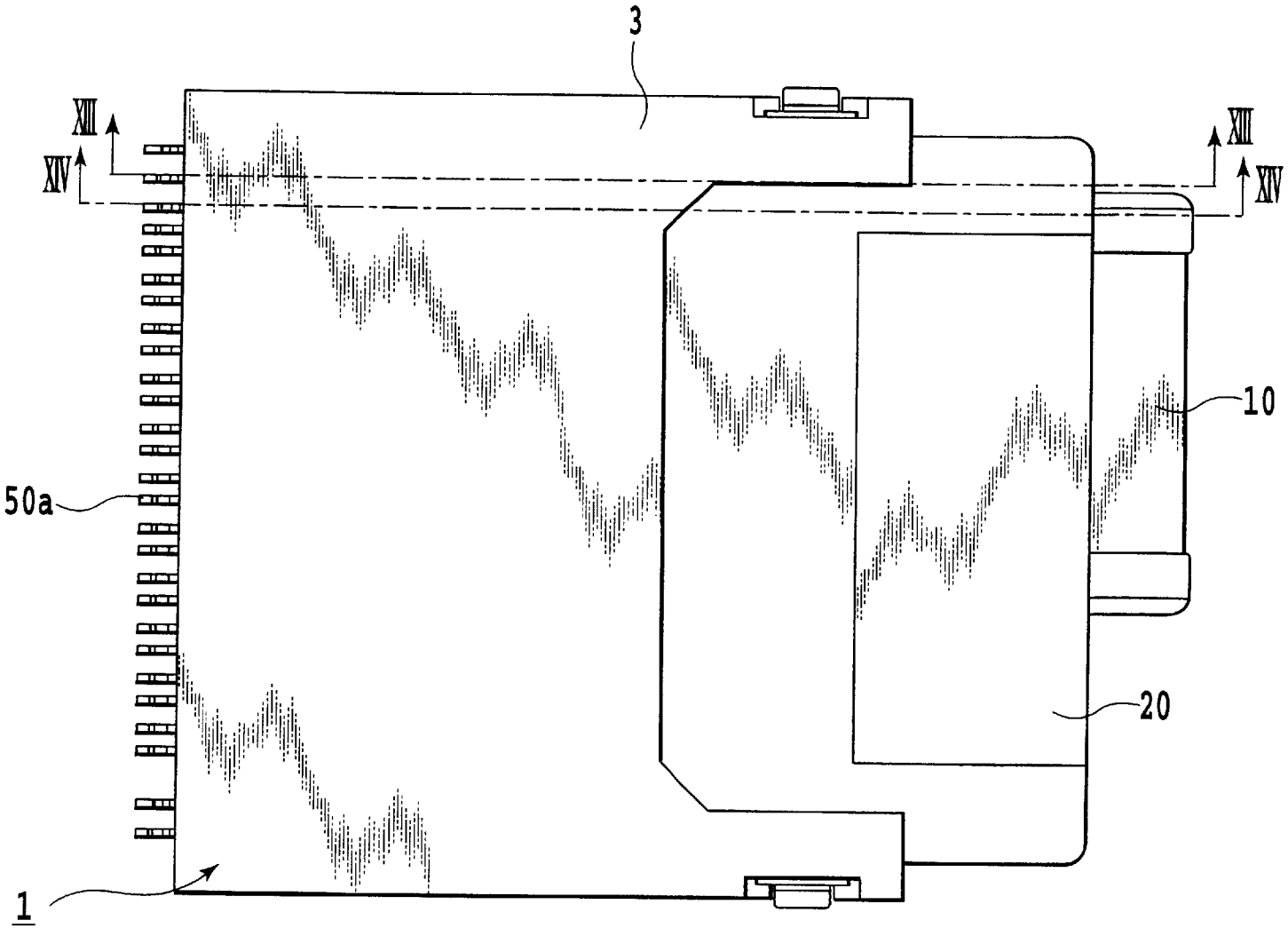
FIG. 6 is a plane view showing the embodiment of the card connector, in the state with respective cards inserted, according to the present invention.
Figure 7:
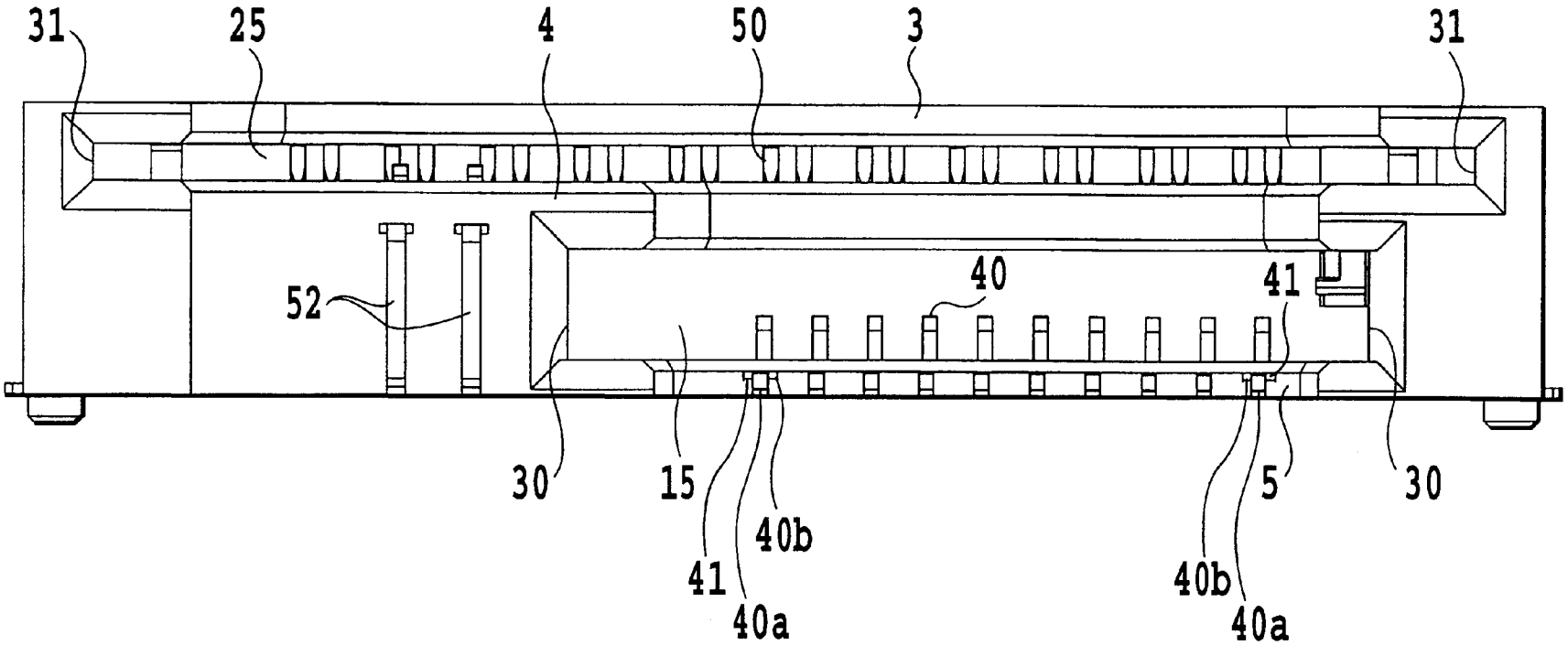
FIG. 7 is a front view showing the embodiment of the card connector according to the present invention.
Figure 8:
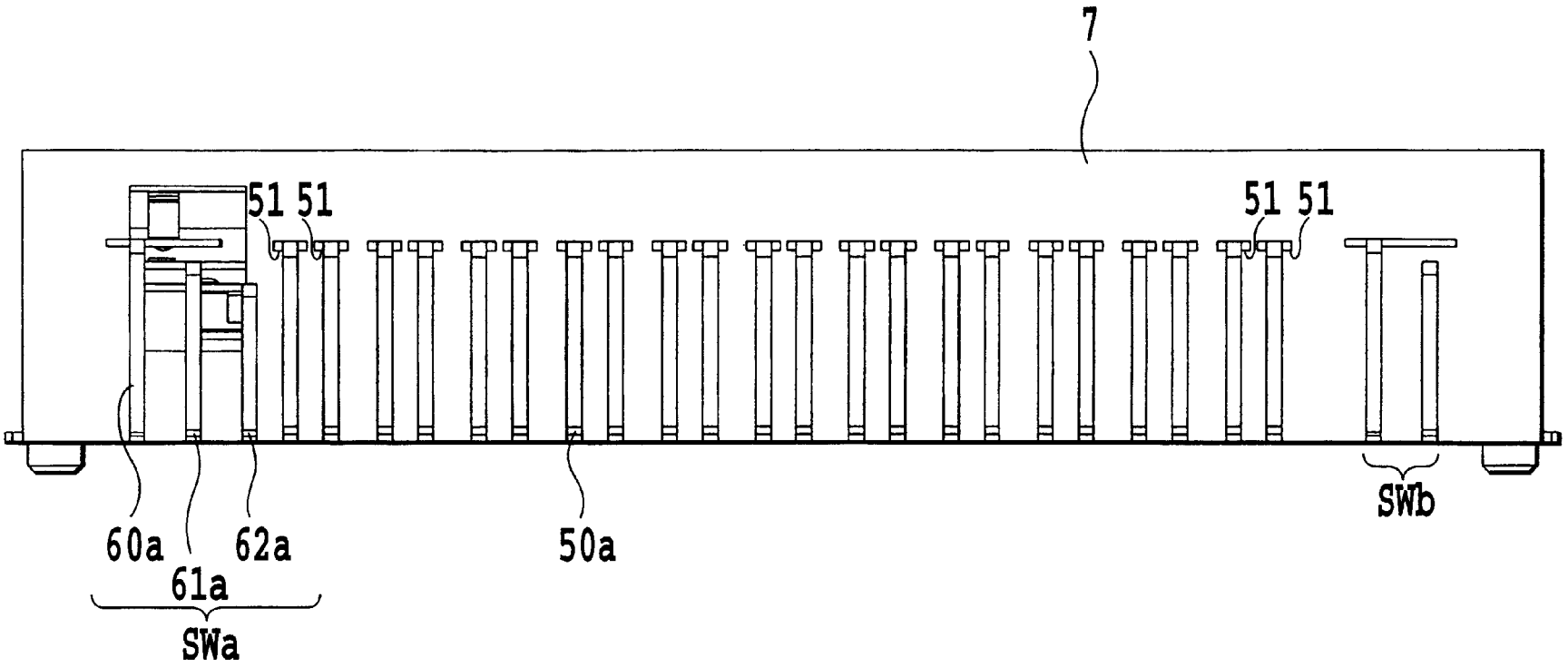
FIG. 8 is a back view showing the embodiment of the card connector according to the present invention.
Figure 9:
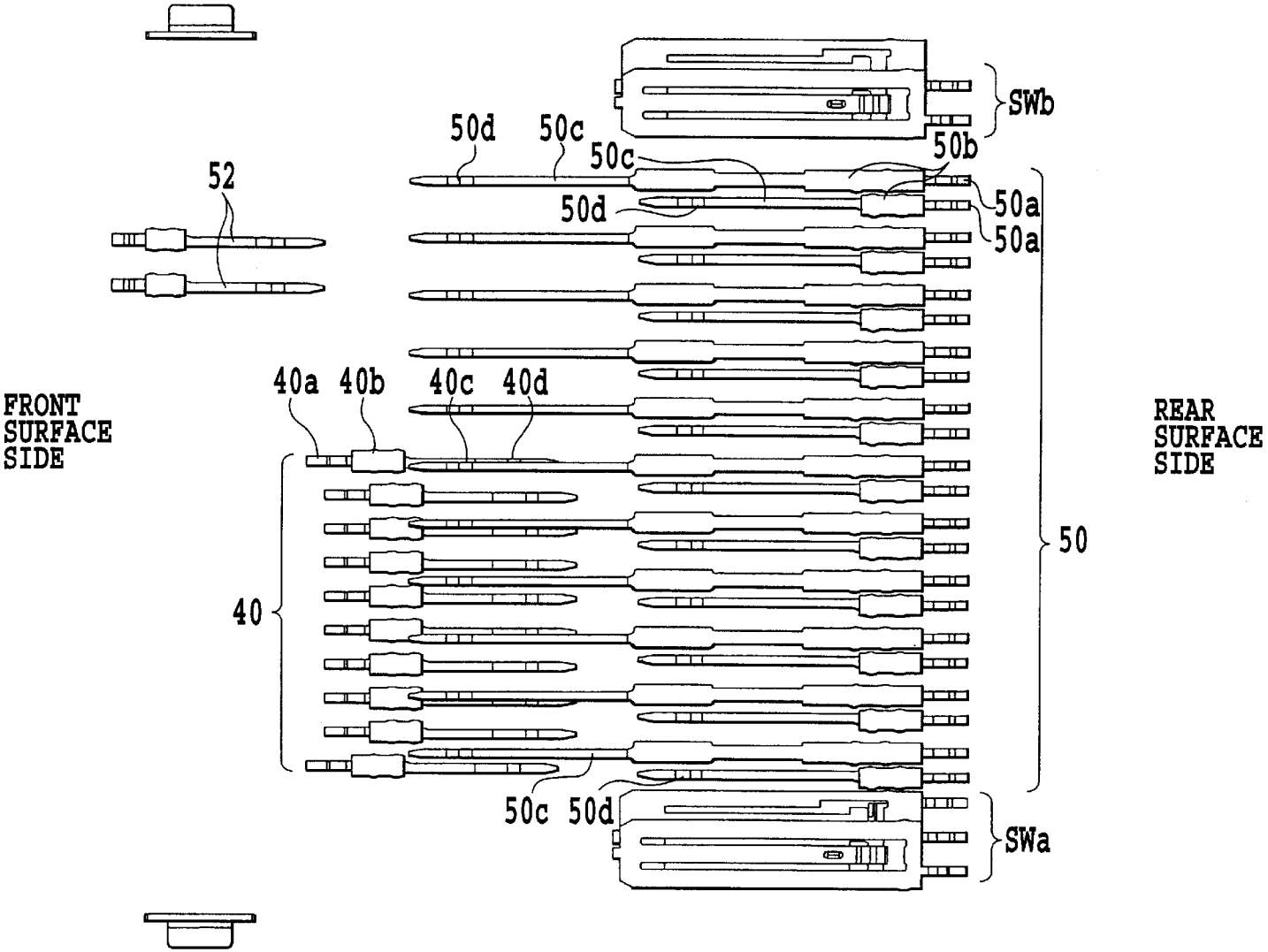
FIG. 9 is a plane view showing arrangement state of contact terminals for both cards.
Figure 10:
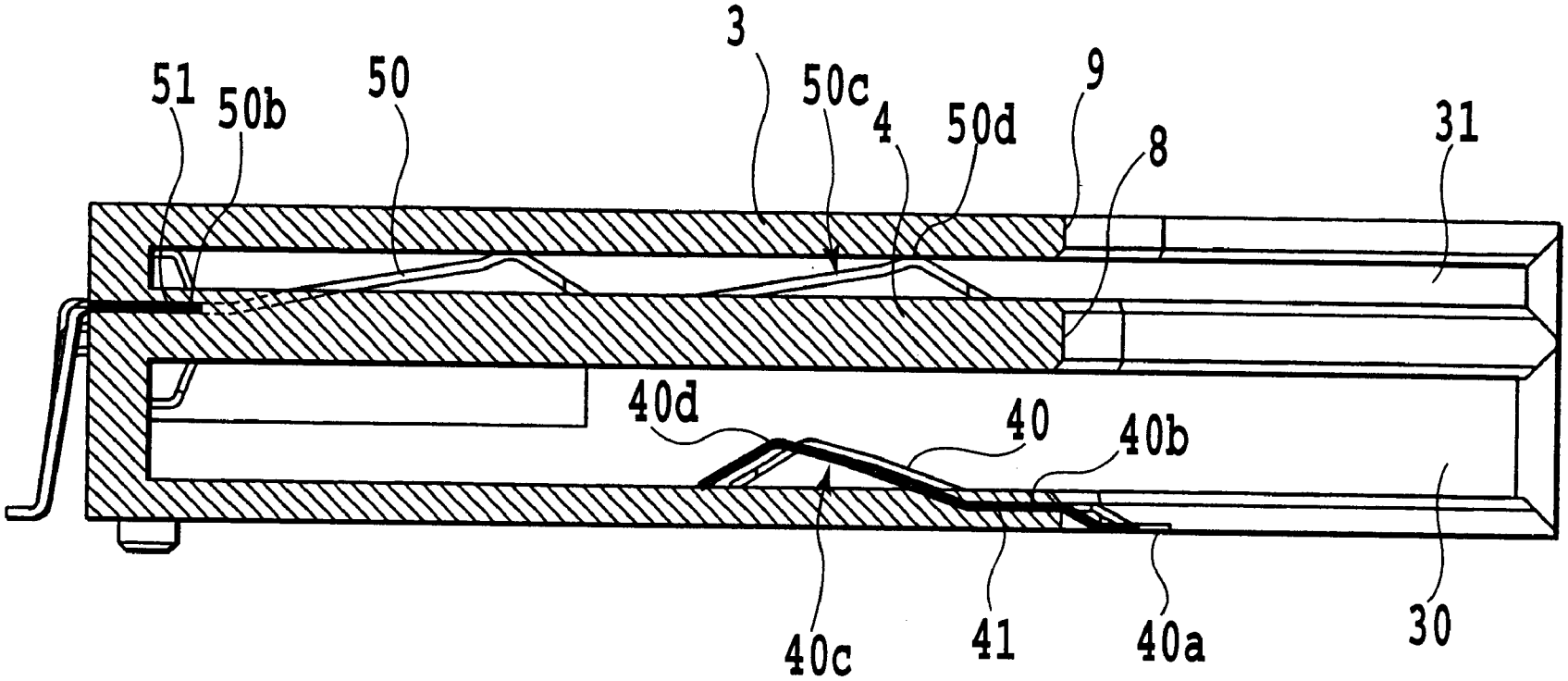
FIG. 10 is a sectional view taken along line X—X of FIG. 5.
Figure 11:
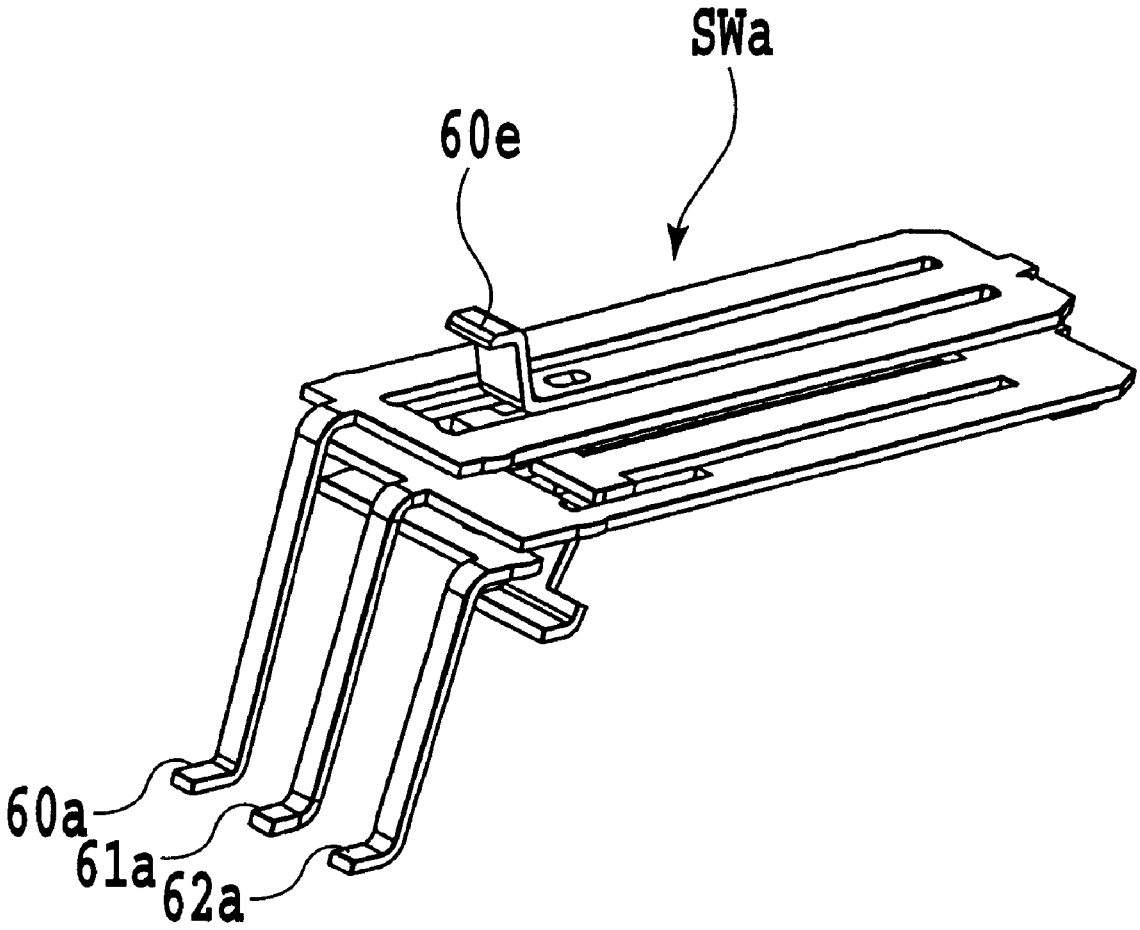
FIG. 11 is a perspective view showing a card recognition switch.
Figure 12:
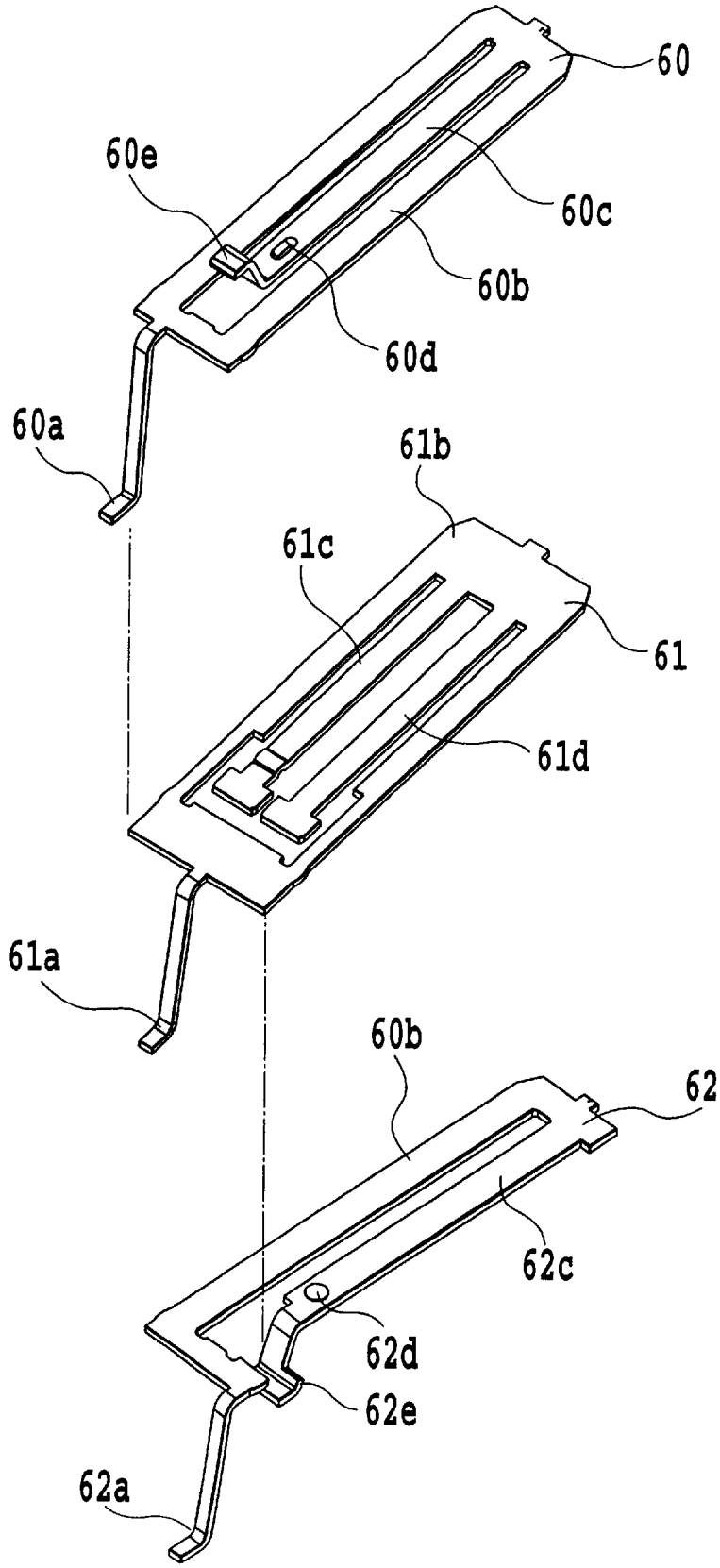
FIG. 12 is an exploded perspective view of the card recognition switch of FIG. 11.
Figure 13:
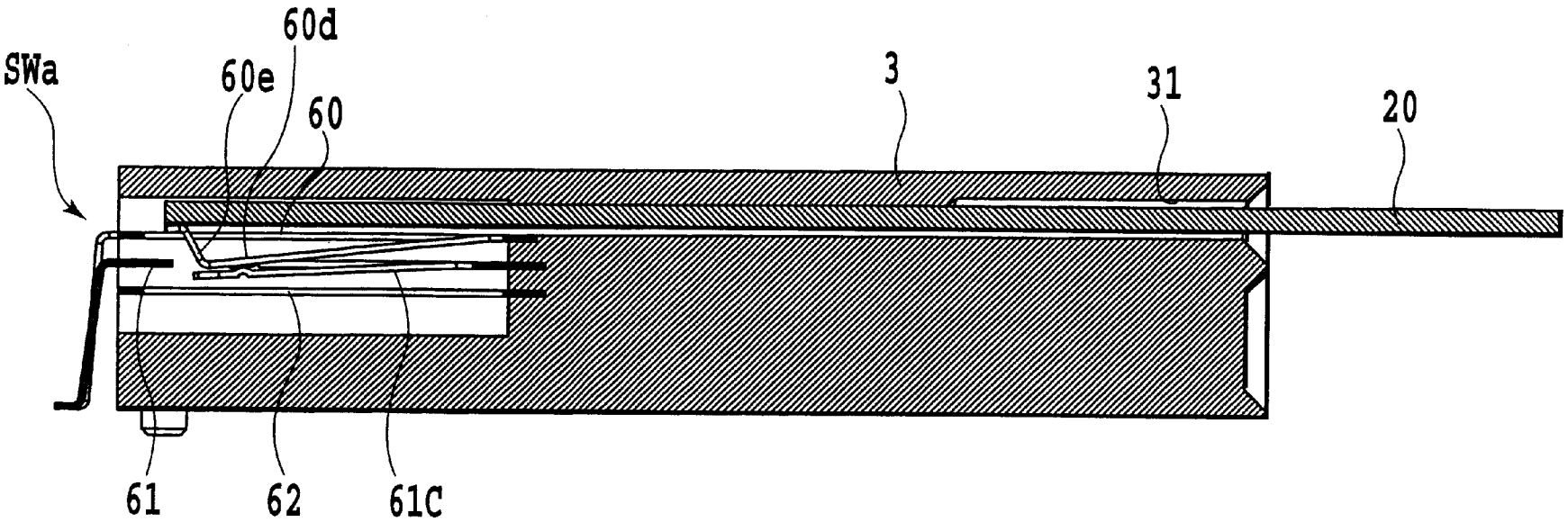
FIG. 13 is a sectional view taken along line XIII—XIII of FIG. 6.
Figure 14:
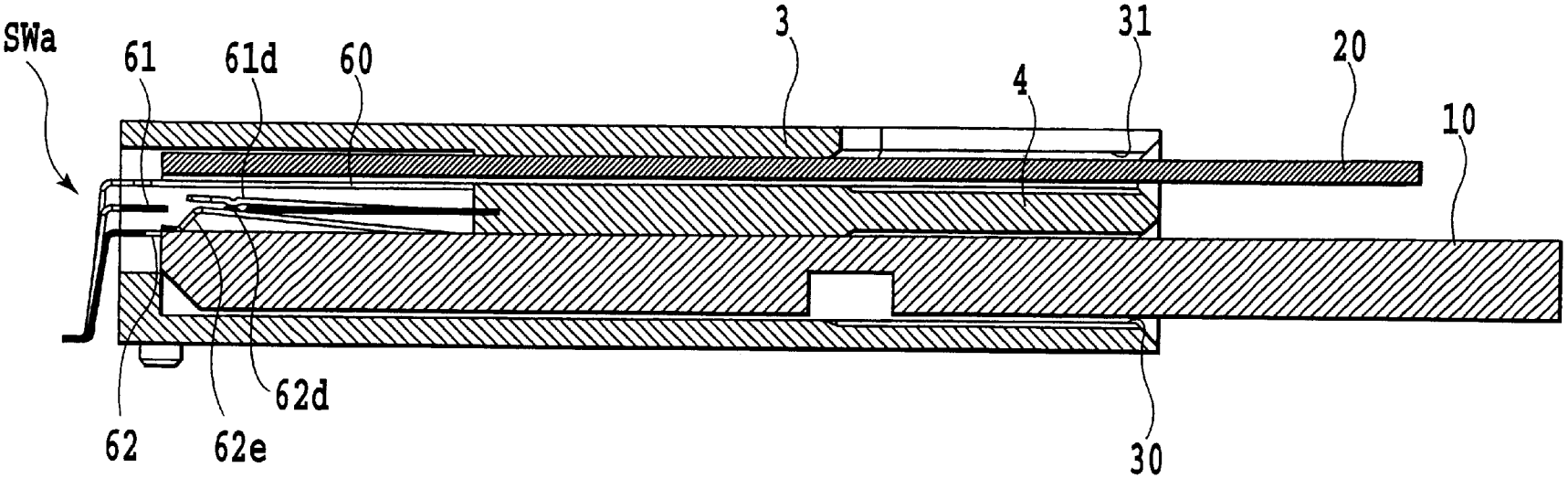
FIG. 14 is a sectional view taken along line XIIII—XIIII of FIG. 6.

FIG. 3 is a perspective view showing the outer appearance of a card connector 1 as viewed from the upper side, FIG. 4 is a perspective view showing the outer appearance of the card connector 1 in a card inserted state, shown in reverse, that is, upside down, FIG. 5 shows a plane view of the card connector 1, FIG. 6 shows a plane view of the card connector 1 in a card inserted state, FIG. 7 is a front view showing the front surface side of the card connector 1, FIG. 8 is a rear view showing the rear surface side of the card connector 1, FIG. 9 is a plane view showing arrangement state of contact terminals for two cards with the card connector housing omitted, FIG. 10 is a sectional view taken along line X—X of FIG. 5, FIG. 11 is a perspective view showing a card recognition switch SWa, FIG. 12 is an exploded perspective view of the card recognition switch of FIG. 11, FIG. 13 is a sectional view taken along line XIII—XIII of FIG. 6, and FIG. 14 is a sectional view taken along line XIIII—XIIII of FIG. 6.

The card connector 1 shown in these figures is incorporated in electronic machines such as cellular phones, PDA, portable audios, cameras and the like, and the above-described narrow-type card 10 and the thin-type card 20 are inserted in the connector 1 in a positional relation of upper and lower sides. In this case, the narrow-type card 10 is inserted in a lower slot 15, and the thin-type card 20 in an upper slot 25.

The card connector 1 has a connector housing 2 molded from an insulator such as a resin material. The connector housing 2, as shown in FIGS. 3 and 4, comprises an upper plate 3, a middle plate 4, a lower plate 5, right and left side plates 6, a rear plate 7 and the like.

As shown in FIGS. 3 and 7, a card slot (lower slot) 15 is formed between the middle plate 4 and the lower plate 5 of the connector housing 2 for detachably mounting the narrow-type card 10 in the connector. Further, between the middle plate 4 and the upper plate 3, a card slot (upper slot) 25 is formed for detachably mounting the thin-type card 20 in the connector.

On the front surface side of the connector housing 2, by cutting out part of the middle plate 4 and the lower plate 5, a recess 8 recessing towards the rear surface side is formed. At the recessed part of the recess 8, a soldered portion 40*a* of a contact terminal 40 for the narrow-type card 10 is disposed in opposition. Therefore, as to this part, the soldered portion 40*a* of the contact terminal is disposed inside the outer periphery of the connector housing 2, which reduces the substrate occupation area of the connector housing 2.

A similar recess 9 is also formed at the front surface side of the upper plate 3, therefore, the thin-type card 20 is made easily detachable.

On both sides of the lower slot 15, guide grooves 30 for guiding attachment and detachment of the narrow-type card 10 are formed, the narrow-type card 10 is guided by the guide grooves 30 in the state with the contact pad surface facing down, and attached and detached along the direction shown by an arrow DE in FIG. 3.

As shown in FIGS. 7 and 10, at the inner surface side of the housing lower plate 5, a plurality of grooves 41 are formed for positioning and press-fitting the plurality (in this case, 10 pieces) of contact terminals 40 for the narrow-type card 10. The respective grooves 41 extend along the direction shown by the arrow DE in FIG. 3. Further, the plurality of grooves 41 are formed on the same plane along a direction almost perpendicular to the direction shown by the arrow DE.

Each respective contact terminal 40 comprises a cantilever contact spring and, as shown in FIG. 9, has a soldered portion 40*a* soldered to the contact pad of the printed circuit board of the electronic machine, a fixing portion 40*b* for fixing in the groove 41, an elastically deformable contact spring portion 40*c*, and a contact portion 40*d* protruding upward and coming in contact with the contact pad 13 of the card 10.

The plurality of contact terminals 40 for the narrow-type card 10 are press-fitted from the front surface side of the card housing 2 in the card insertion direction so that the fixing portion 40*b* is fixed in the groove 41 formed in the housing. That is, the respective soldered portions 40*a* of these contact terminals 40 are disposed at the front surface side of the card housing 2 (in this case, at positions corresponding to the recesses 8 formed at the front surface side).

When the narrow-type card 10 is mounted to the lower slot 15 in the state with the contact pad surface side down, the respective contact pads 13 of the narrow-type card 10 contact with contact portions 40*d* of the respective contact terminals 40.

On both sides of the upper slot 25, on the other hand, guide grooves 31 for guiding attachment and detachment of the thin-type card 20, and the thin-type card 20 is guided by the guide grooves 31 in the state with the contact pad surface side down to be attached and detached along the direction shown by the arrow DE in FIG. 3.

As shown in FIG. 10, at the upper surface side of the housing middle plate 4, a plurality of grooves 51 are formed for positioning, press-fitting in and fixing a plurality of contact terminals 50 for the thin-type card 20. The respective grooves 51 extend along the direction shown by the arrow DE in FIG. 3. Further, the plurality of grooves 51 are formed on the same plane along the direction almost perpendicular to the direction shown by the arrow DE.

Each contact terminal 50 for the thin-type card 20, as shown in FIG. 9, comprises two types of long contact terminals and short contact terminals, so that the short contact terminal is disposed between arrangement pitches of the long contact terminal. Each contact terminal 50, as shown in FIG. 9, comprises a cantilever contact spring leaf, and has a soldered portion 50*a* soldered to the contact pad of the printed circuit board of the electronic machine, a fixing portion 50*b* for fixing in the groove 51, an elastically deformable contact spring 50*c*, and a contact portion 50*d* protruding upward and coming in contact with the contact pad 23 of the thin-type card 20.

These plurality of contact terminals 50 for the thin-type card 20, by being press-fitted from the rear surface side of the connector housing 2 in the card detachment direction, its fixing portion 50*b* is fixed in the groove 51 formed in the housing. That is, the respective soldered portions 50*a* of these contact terminals 50, as shown also in FIG. 8, are disposed in the exposed state at the rear surface side of the connector housing 2.

When the thin-type card 20 is mounted to the upper slot 25 in the state with the contact pad surface side down, the respective contact pads 23 of the thin-type card 20 contact with contact portions 50*d* of the respective contact terminals 50.

The housing middle plate 4 is provided with two contact terminals 52 for detecting the presence or absence of a write protect pad 24 of the thin-type card 20. Press-fit direction of these two contact terminals 52 into a mounting groove (not shown) is the same as the press-fit direction of the contact terminal 40 for the thin-type card 10 into the above-described groove 41.

Further, as shown FIG. 9, at both ends of the connector housing 2, respective card recognition switches SWa and SWb for detecting the presence or absence of load of the cards are disposed. Contact portions of these switches SWa and SWb are, respectively as shown in FIGS. 8 and 14, disposed on the housing middle plate 4.

One card recognition switch SWb is for detecting the load of a thin-type card 20' shown by the chain double-dashed line in FIG. 2 in which the chamfered portion 21 is disposed at the reverse side to one which is shown in FIG. 2, and comprises two metal strips disposed in upper and lower sides.

The other card recognition switch SWa is for detecting the presence or absence of load of the thin-type card 20 and the narrow-type card 10 shown in FIG. 2, and, as shown in FIGS. 11 and 12, comprises three strips 60, 61 and 62 of metal disposed in upper and lower sides.

The strip 60 of metal positioned at the top has a soldered portion 60*a* soldered and fixed to the contact pad of the printed circuit board, a frame fixing portion 60*b* fixed to the middle plate 4 of the connector housing 2, a spring piece 60*c* extending in the cantilever form from one end of the frame fixing portion 60*b*, a contact portion 60*d*, and a card contact portion 60*e* bent protrudingly to the upward and coming in contact with the thin-type card 20.

The strip 61 of metal positioned in the middle has a soldered portion 61*a*, a frame fixing portion 61*b*, and two contacts 61*c* and 61*d* extending in parallel in the cantilever form from one end of the frame fixing portion 61*b*.

The strip 62 of metal positioned at the bottom side has a soldered portion 62*a*, a frame fixing portion 62*b*, a spring piece 62*c* extending in the cantilever form from one end of the frame fixing portion 62*b*, a contact portion 62*d*, and a card contact portion 62*e* bent protrudingly to the downward and coming in contact with the narrow-type card 10.

In the switch SWa, the respective strips 60 to 62 are disposed so that the spring piece 60*c* of the strip 60 of metal and the contact portion 61*c* of the strip 61 of metal overlap vertically, and the contact portion 61*d* of the strip 61 of metal and the spring piece 62*c* of the strip 62 of metal overlap vertically. At this time, the soldered portion 60*a* to 62*a* of the respective strips 60 to 62, as shown in FIG. 8, respectively together with the above soldered portion 50*a*, are exposed adjacent to each other from the rear surface side of the connector housing 2.

In the recognition switch SWa, when the thin-type card 20 is loaded, as shown in FIG. 13, since the card contact portion 60*e* of the upper side strip 60 of metal comes in contact with the thin-type card 20 and the card contact portion being pressed, the spring piece 60*c* is deformed downward, as a result, the contact portion 60*d* contacts the contact portion 60*c* of the middle side strip 61 of metal. As shown, the card recognition switch for the thin-type card 20 comprises the upper side strip 60 of metal and the middle side strip 61 of metal.

On the other hand, when the narrow-type card 10 is loaded, since the card contact portion 60*e* of the lower strip 62 of metal comes in contact with the narrow-type card 10 and the card contact portion being pressed, as shown FIG. 14, the spring piece 60*c* is deformed upward, as a result, the contact portion 62*d* contacts the contact portion 61*d* of the middle side strip 61 of metal. Thus, the card recognition switch for the narrow-type card 10 comprises the middle side strip 61 of metal and the lower side strip 62 of metal.

In this structure of the recognition switch SWa, the middle side strip 61 of metal is commonly used, however, by employing two lines of detection circuits, load state of the cards 10 and 20 (which card is loaded) can be recognized.

As described above, in the present embodiment, since the slots 15 and 25 for the two types of card are disposed at the upper and lower sides, the respective soldered portions 40*a* of the contact terminal 40 for one card 10 are disposed at the front surface side of the connector housing 2, and the respective soldered portions 50*a* of the contact terminal 50 for the other card 20 are disposed in the exposed state at the rear surface side of the connector housing 2, the soldered portions 40*a* and 50*a* of the contact terminals 40 and 50 for the two types of card do not interfere with each other, and the respective soldered portions 40*a* and 50*a* can be arranges in respective lines easily. Therefore, press-fitting operation of the respective contact terminals becomes easy, image recognition of the soldered portions when the board is mounted or for image inspection of the soldered portion becomes easy, and repair work using an soldering iron becomes easy.

Further, since the slots 15 and 25 for the two types of card are disposed at upper and lower sides, it is possible to dispose the card recognition switches for the respective cards at near positions. Still further, since, in the above card recognition switch SWa, the strip 61 of metal positioned at the center is commonly used by two card recognition switches, the card recognition switch SWa can be formed of three strips 60 to 62 of metal. Therefore, the number of parts is reduced, and the connector is miniaturized and the connector has been slimmed down.

In the above-described embodiment, the narrow-type card 10 is loaded in the lower slot 15 and the thin-type card 20 is loaded in the upper slot 25, however, this positional relation may be reversed.

Further, in the above embodiment, MEMORY STICK™ is used as an example of the narrow-type card 10, and SMART MEDIA™ as an example of the thin-type card 20, however, the present invention may be applied to any other types of card.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A card connector capable of containing at least a first card having a first contact pad and a second card having a second contact pad wherein the first card and the second card differ in outer shape and contact pad position, said card connector comprising, a connector housing configured so that a first slot for containing said first card is disposed at one of an upper side and a lower side of the connector housing and a second slot for containing said second card is disposed at the other one of the upper side and the lower side wherein the first slot is wider than the second slot;

a plurality of first contact terminals wherein each of the plurality of first contact terminals comprises a soldered portion, an elastically deformable contact spring portion, and a contact portion for coming in contact with the first contact pad of the first card;

a plurality of second contact terminals wherein each of the plurality of second contact terminals comprises a soldered portion, an elastically deformable contact spring portion, and a contact portion for coming in contact with the second contact pad of the second card, wherein the plurality of first contact terminals are disposed so that the respective soldered portions of the plurality of first contact terminals for said first card are positioned at one of a front surface side and a rear surface side of said connector housing, and wherein the plurality of second contact terminals are disposed in an opposite direction to said first contact terminals so that the respective soldered portions of the plurality of second contact terminals for said second card are positioned at the other one of the front surface side and the rear surface side of said connector housing.

2. The card connector of claim 1, further comprising:

a recess wherein the recess recesses towards the rear surface side and is formed in a part of the front surface side of said connector housing, wherein a contact terminal for said first or said second card is disposed so that its soldered portion is disposed in said recess.

3. The card connector of claim 1, wherein said first and said second cards respectively have memory locations capable of making data write or data read.

4. The card connector of claim 1, further comprising:

a first card recognition switch for detecting the presence or absence of the first and second cards, wherein the first card recognition switch comprises a first part, a second part, and a third part configured so that the first part and the second part detect the presence or absence of the first card and the third part and the second part detect the presence or absence of the second card.

5. The card connector of claim 4, further comprising a second card recognition switch for detecting the presence or absence of a third card wherein the third card differs from any one of said first and said second cards.

6. The card connector of claim 4, wherein the first part, the second part, and the third part of the card recognition switch each have at one end a soldered portion, wherein the first part, the second part, and the third part are disposed so that the respective soldered portion are positioned at the rear surface side of said connector housing along with the soldered portions of said plurality of first contact terminals or the soldered portions of said plurality of second contact terminals so that said soldered portions are adjacent to each other.

7. The card connector of claim 4, wherein:

the first part of the first card recognition switch comprises a first spring piece for detecting said first card wherein the first spring piece comprises a first contact portion, the third part of the first card recognition switch comprises a second spring piece for detecting said second card wherein the second spring piece comprises a second contact portion, and the second part of the first card recognition switch comprises a third and fourth contact portions capable of being electrically connected to the first contact portion of said first spring piece and the second contact portion of said second spring piece, respectively.

8. The card connector of claim 1, further comprising:

a first mounting portion; and a second mounting portion, wherein each of said plurality of first contact terminals further comprises a first fixing portion for fixing the plurality of first contact terminals to the first mounting portion, wherein each of said plurality of second contact terminals further comprises a second fixing portion for fixing the plurality of second contact terminals to the second mounting portion, wherein the first mounting portion is formed on said connector housing along a direction generally perpendicular to an attachment and detachment direction of said first card with respect to said first slot, wherein the second mounting portion is formed on said connector housing along a direction generally perpendicular to an attachment and detachment direction of said second card with respect to said second slot, and wherein the first mounting portion and the second mounting portion are disposed so that the plurality of first contact terminals and the plurality of second contact terminals are fixed in opposition to each other.

9. The card connector of claim 8, wherein:

each of said plurality of first contact terminals further comprises a first contact portion wherein for each plurality of first contact terminals the first fixing portion is formed between the contact portion and the soldered portion, each of said plurality of second contact terminals further comprises a second contact portion wherein for each plurality of second contact terminals the second fixing portion is formed between the contact portion the soldered portion.

10. The card connector of claim 8, wherein:

said first mounting portion is formed at said rear surface side of said first slot in said connector housing, and said second mounting portion is formed at said front surface side of said second slot in said connector housing.

* * * * *